United States Patent [19]

Deziel

[11] Patent Number: 4,725,000

[45] Date of Patent: Feb. 16, 1988

[54] ENCLOSURE ASSEMBLY

[76] Inventor: Edward W. Deziel, 902 Felix St., West St. Paul, Minn. 55118

[21] Appl. No.: 24,619

[22] Filed: Mar. 11, 1987

[51] Int. Cl.[4] ..... E06B 9/08

[52] U.S. Cl. ..... 160/133; 160/84 R

[58] Field of Search ..... 160/133, 84 R, 220

[56] References Cited

U.S. PATENT DOCUMENTS

| | | | |
|---|---|---|---|
| 31,300 | 2/1861 | Cochrane | 160/133 |
| 2,349,702 | 5/1944 | Campion | 160/133 |
| 2,390,116 | 12/1945 | Michelman | 160/133 |
| 2,584,134 | 2/1952 | Knutson | 160/220 |
| 3,051,231 | 8/1962 | Alvarez | 160/220 X |
| 4,345,635 | 8/1982 | Solomon | 160/133 |
| 4,524,814 | 6/1985 | Deziel | 160/133 |
| 4,601,953 | 7/1986 | Haffer | 160/133 X |

FOREIGN PATENT DOCUMENTS

| | | | |
|---|---|---|---|
| 2458667 | 2/1981 | Fed. Rep. of Germany | 160/133 |

*Primary Examiner*—Robert W. Gibson, Jr.
*Attorney, Agent, or Firm*—William L. Huebsch

[57] ABSTRACT

An enclosure assembly including a frame having guides for positioning a plurality of stiff elongate panels across an opening through the frame one above another in edge-to-edge relationship and for affording edgewise movement of the panels along the guides through the top of the frame to an open position. The panels are attached together by lengths of non porous flexible material attached along the adjacent edges of each pair of adjacent panels so that the lengths of flexible material form into a generally cylindrical projections from the sides of the adjacent panels when the panels are supported on each other. The lengths of non porous flexible material are tensioned between the panels to lift the lower panels when the uppermost panel is lifted in the guides by rotating a plate like spindle at the top of the frame to wrap on the panels and move the panels to the open position.

15 Claims, 5 Drawing Figures

ENCLOSURE ASSEMBLY

TECHNICAL FIELD

This invention relates to enclosure assemblies, and in particular to enclosure assemblies particularly adapted for use as the windows of structures such as porches which have a large window area to wall area ratio.

BACKGROUND ART

Many enclosure assemblies used in the windows of structures which have a large window area to wall area ratio (e.g., porches, structures around swimming pools, greenhouses, and animal shelters) comprise a frame defining a through opening over which screen extends, and panels comprising sheets of transparent material (e.g., polymeric material or glass) that may be slid along tracks or pivoted at their edges between closed and open positions to respectively extend across or uncover portions of the screened opening. In their open positions, sliding panels typically cover large portions of such openings and, if such panels are large, they can be difficult to move and can stick in their tracks. Pivotal panels remain in the line of vision when they are open. With either type of panels, a designer must choose between (1) minimizing the framing around the transparent material in the panels, which minimizes the open feeling of the enclosure assemble, but limits the panel size and allows the transparent material to be more easily broken due to the minimal support by the framing; or (2) using more framing which allows larger panels to be used but reduces the visibility through or past the panels in either their open or closed positions.

My U.S. Pat. No. 4,524,814 issued June 25, 1985, (incorporated herein by reference) describes an enclosure assembly which is particularly useful in the windows of structures where a large window area to wall area ratio is desired, which enclosure assembly has good strength with a minimum of framing and can be either (1) closed so that panels cover an opening, (2) partially opened so that alternating panels and lengths of screen cover the opening, or (3) fully opened to totally uncover the opening.

That enclosure assembly includes a plurality of stiff elongate generally rectangular panels, and means mounting the panels in edge-to edge relationship for edgewise sliding movement along a predetermined path across the opening to afford relative movement of adjacent panels between (1) a closed position with panel edges of the adjacent panels together so that several pairs of adjacent panels in their closed positions can cover the opening; and (2) a spaced position with the adjacent panels spaced apart and lengths of flexible material, many of which are screen, attached between the panels extending across the space between the adjacent panels so that with one or more spaced adjacent panels across the opening some of the opening will be covered only with screen. Means are provided for relatively moving adjacent panels across the opening between their closed and spaced positions, and for further moving all of the panels and lengths of flexible material or screen interconnecting them completely away from the opening so that the opening is free from any obstruction. Such means for moving the panels can comprise a frame defining the opening and the path, which frame has a top, guide means for positioning the panels across the opening one above the other with the panel edges extending horizontally and positioned vertically one above another, and support means adapted to engage and support the bottom edge on the lowermost panel of a stack of adjacent panels in their closed positions and covering the opening. Means are also included which may be in the form of a manually rotatable spindle at the top of the frame adapted to roll on the panels and their interconnecting lengths of flexible material or screen, for sequentially lifting the panels out of the top of the frame to sequentially move adjacent panels in the stack covering the opening to their spaced positions downwardly from the top of the frame until the opening is covered by adjacent panels in their spaced positions with interconnecting lengths of screen between the panels and the enclosure assemble is in the partially open position, and to subsequently lift all of the panels out of the top of the frame so that the enclosure is fully open with none of the panels or strips of flexible material extending across the opening.

The panels preferably each comprise an elongate slat that is of an opaque, translucent, or transparent stiff material such as Plexiglas or fiberglass, or which could be of another suitable decorative material such as wood or a thermal insulating material such as polystyrene. The panels additionally can have their panel edges adapted to nest together generally in the manner of a tongue and groove to restrict movement of air and moisture between adjacent panels when they are in their closed positions. The lengths of screen are held along corresponding sides of adjacent panels they interconnect by strips defining the longitudinal panel edges in a manner that causes the lengths of screen to bend generally into cylindrical projections from those corresponding sides when the adjacent panels they interconnect are in their closed positions, and which causes the lengths of screen to be tensioned around and between the strips when the adjacent panels they interconnect are separated.

While that enclosure assembly is quite acceptable and provides many advantages in many structures, it has been found to have certain disadvantages. The use of screen as the flexible material allows more air and moisture infiltration than may be desired between adjacent panels despite their tongue and groove like mating edges, and the appearance of large cylindrical projections of screen adapted to be stretched between panels is objectionable to some. The enclosure assembly is not capable of providing 100 percent ventilation through the opening with screen across the entire opening to prevent passage of bugs. Also, the widths of the panels are limited by use of three equally spaced support edges on the spindle by which the panels are lifted.

DISCLOSURE OF INVENTION

The present invention provides an improved enclosure assembly which, like my enclosure structure described above, is also particularly useful in the windows of structures were a large window area to wall area ratio is desired and has good strength with a minimum of framing, but which, compared to that enclosure structure, provides greater restriction of infiltration of air and moisture when closed, can use panels with a greater vertical width for similar applications so that it has a more pleasing and conventional appearance, and can be incrementally or fully opened to provide, as a maximum, total screened ventilation through the opening.

According to the present invention there is provided an enclosure assembly comprising, like my enclosure assembly described above, a plurality of stiff elongate generally rectangular panels having parallel longitudinal panel edges and major side surfaces; a frame defining a central through opening, having a top, guide means for positioning panels disposed across the opening one above another in edge-to edge relationship and for affording edgewise movement of the panels along the guide means through the top in a direction generally normal to the panel edges, and support means adapted to support the lowermost panel of a stack of adjacent panels across the opening; a plurality of elongate, generally rectangular lengths of flexible material each of which has opposite parallel longitudinal edges and edge portions adjacent the edges; means along the adjacent edges of each pair of adjacent panels for attaching the edge portions of a different one of the lengths of flexible material along corresponding side surfaces of the adjacent panels with the edges of the flexible material adjacent the edges of the adjacent panels to form the length of flexible material into a generally cylindrical projection from the corresponding side surfaces when the uppermost one of the adjacent panel edges is supported on the other, which lengths of flexible material are tensioned around and between the means for attaching to cause movement of the panels when the uppermost panel is lifted in the guide means; and means for affording movement of the panels relative to the frame from a closed position with the panels covering the opening through the frame and supported one above the other, and an open position with all of the panels lifted above that opening.

In the improved enclosure assembly according to the present invention, unlike the enclosure assembly described above, however, the lengths of flexible material are non porous which restricts movement of air and moisture between the adjacent edges of the panels. Also, the rectangular panels are generally wider between their longitudinal edges (e.g., preferably in the range of 10 to 14 inches in width) which provides improved visibility when the assembly is closed, and the lengths of flexible material also have generally uniform widths (e.g., preferably in the range of two to five inches in width) so that they do not form large cylindrical projections when the edges of adjacent panels they connect are in contact, and cause relatively little relative movement of the panels away from each other when they are lifted above the through opening by the interconnection of the lengths of flexible material.

In one preferred embodiment of the enclosure assembly according to the present invention, each of the panels comprises a slat of stiff transparent polymeric material, the means attaching the edge portions of the flexible material to the adjacent panels comprises decorative strips of wood on the side of the edge portions opposite the slats, and the lengths of flexible material are transparent polymeric material (e.g., U.V. stabilized vinyl film) through which the wood can be seen, and which, from a distance, can not be seen, but give the appearance of a high gloss finish on the wood strips. Alternatively, the lengths of flexible material may be of opaque or colored transparent or translucent film. Also, lengths of the flexible material may be attached on both sides of the panels if even more resistance to weathering and infiltration of air and moisture is desired.

Also, as in the enclosure assembly described above, the means for affording movement of the panels from the closed to the open positions preferably comprises a spindle mounted adjacent the top of the frame for rotation about a generally horizontal axis, which spindle has axially extending support edges spaced from the axis; and means for attaching the uppermost edge of the uppermost of the panels to the spindle so that the spindle may be rotated to wrap the panels and lengths of flexible material around the support edges. In the present invention, unlike that previously described enclosure assembly, however, the spindle has only two support edges about equally spaced from opposite sides of the axis, and the means for attaching, the widths of the panels, and the widths of the lengths of flexible material are adapted to position the lengths of flexible material around the support edges and the panels between the support edges generally parallel to each other as the panels and lengths of flexible material are wound around the spindle which provides a more compact spindle than was provided in my previously described enclosure assembly.

Additionally, and preferably for use in locations having insects, a piece of screen can be attached to the frame across the through opening at a position spaced from and generally parallel to the guide means so that the opening through the frame is covered by screen when the panels are in their open position.

BRIEF DESCRIPTION OF DRAWING

The present invention will be further described with reference to the accompanying drawing wherein like numbers refer to like parts in the several views, and wherein.

DETAILED DESCRIPTION

Figure 1:
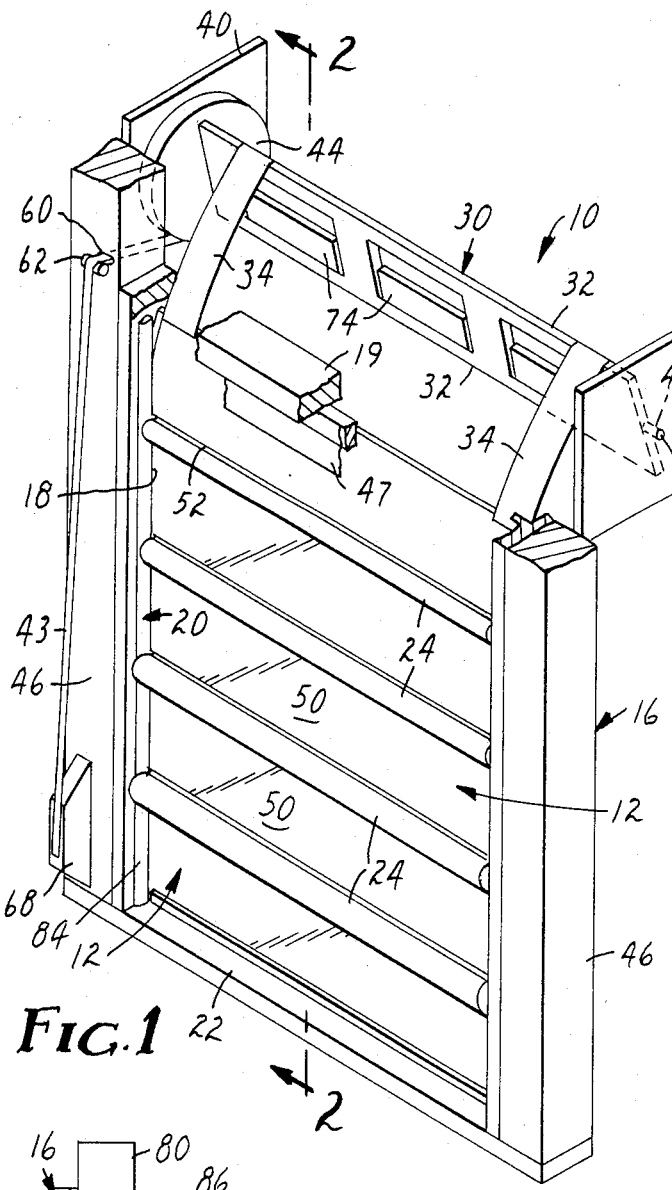
FIG. 1 is a perspective view of an enclosure assembly according to the present invention showing a closed position for panels of the enclosure assembly and having parts broken away to show details.

Referring now to the drawing, there is shown an enclosure assembly according to the present invention generally designated by the reference numeral 10.

Generally the enclosure assembly 10 comprises a plurality of stiff elongate generally rectangular panels 12 having parallel longitudinal panel edges 14, generally uniform widths between the panel edges 14 (i.e., preferably in the range of about ten to fourteen inches), and major side surfaces 15; a frame 16 defining a central through opening 18, having a top 19, guide means in the form of spaced pairs of rails 20 for positioning panels 12 disposed across the opening 18 one above another in edge 14 to edge 14 relationship and for affording edgewise movement of the panels 12 along the pairs of rails 20 through the top 19 in a direction generally normal to the panel edges 14, and support means provided by a sill 22 included in the frame 16 adapted to support the lowermost panel 12 of a stack of adjacent panels 12 across the opening 18. Also included are a plurality of elongate, generally rectangular lengths 24 of non porous flexible material, which lengths 24 have generally uniform widths (e.g., in the range of two to five inches), opposite parallel longitudinal edges 26, and edge portions adjacent those edges 26. Means in the form of wood strips 28 and 29 included in the panels 12 are provided along the adjacent edges 14 of each pair of adjacent panels 12 that attach the edge portions of a different one of the lengths 24 of flexible material along corresponding side surfaces 15 of the adjacent panels 12 with the edges 26 of the flexible material adjacent the edges 14 of the adjacent panels 12 to form the length 24 of flexible material into a generally cylindrical projection from the corresponding side surfaces 15 when the uppermost one of the adjacent panel edges 14 is supported on the other. The lengths 24 of flexible material become tensioned around and between the strips 28 and 29 along the panel edges 14 of the adjacent panels 12 and have widths that cause little relative movement of the panels 12 away from each other when the uppermost panel 12 is lifted in the rails 20.

Means are also provided for affording movement of the panels 12 relative to the frame 16 from a closed position with the panels 12 covering the through opening 18 and supported one above the other on the sill 22, and an open position with all of the panels 12 lifted above the opening 18. That means is in the form of a spindle 30 mounted adjacent the top 19 of the frame 16 for rotation about a generally horizontal axis 31. The spindle 30 has only two opposite axially extending support edges 32 each about equally spaced from opposite sides of the axis 31. Means in the form of two or more belts 34 (illustrated as two belts 34) are provided for attaching the uppermost edge 14 of the uppermost of the panels 12 to the spindle 30 so that the spindle may be rotated to wrap the belts 34, panels 12 and strips 24 of flexible material around the support edges 32; the length of the belts 34, the widths of the panels 12, and the widths of the lengths 24 of flexible material being adapted to position the lengths 24 of flexible material around the support edges 32 and the panels 12 between the support edges 32 generally parallel to each other as the panels 12 and lengths 24 of flexible material are wound around the spindle 30.

Preferably, each of the panels 12 comprises slats 50 of stiff transparent polymeric material, the strips 28 and 29 included in the means for attaching the edge portions of the lengths 24 of flexible material along the adjacent panels 12 are of decorative wood positioned on the side of the edge portions opposite the panels 12, and the lengths 24 of flexible material are of transparent polymeric material (e.g., 0.018 inch thick U.V. stabilized vinyl). With such materials, the the wood can be seen through the length 24 of flexible material, and from a distance, the length 24 of flexible material can not be seen but gives the appearance of a high gloss finish on the wood strips 28 and 29. Alternatively, however, the panels 12 could be made of thermal insulating material.

Additionally the enclosure assembly as illustrated includes a piece of screen 36 attached to the frame 16 across the opening 18 at a position spaced from and generally parallel to the rails 20, which screen restricts passage of insects through the through opening 18 when the panels 12 are not closed. The screen 36 can be attached directly to the frame 16 around its periphery, or can include a peripheral frame that can be removably attached to or be pivotably attached by hinges to the frame 16 along one edge so that the screen 36 can be removed or pivoted away from the opening 18 when that is desired.

Figure 3:
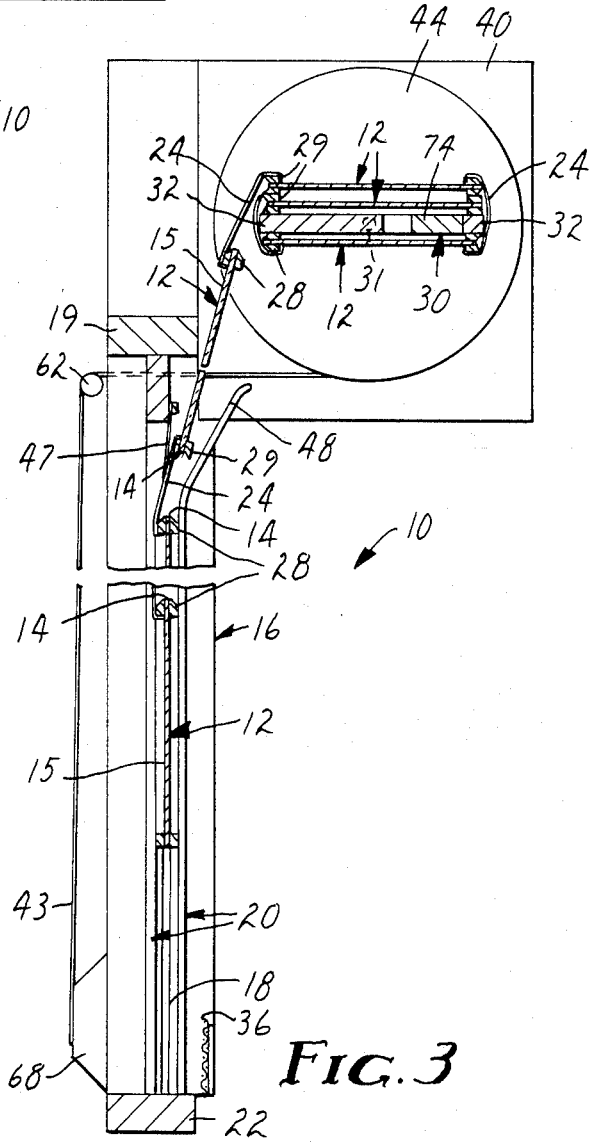

The spindle 30 is mounted adjacent the top 19 of the frame 16 between two rectangular plates 40 for rotation about two horizontal outwardly projecting end pins 42 defining its axis 31, and may be manually rotated trough the use of a strap 43 fixed at one end to and wrapped around a cylindrical periphery of a disk 44 coaxially fixed at one end of the spindle 30. The spindle 30 is a rectangular plate like member having opposite longitudinal edges providing the two support edges 32 each generally equally spaced on opposite sides from the pins 42 at its axis 31. One of the longitudinal edges 14 of the uppermost panel 12 is attached to one of the support edges 32 by the two flexible belts 34 so that the spindle 30 may be rotated to wrap the belts 34 and then sequentially the panels 12 and their interconnecting lengths of flexible material 24 around the support edges 32. The widths of the panels 12 and their interconnecting lengths of flexible material 24 are selected so that the panels 12 can be wrapped around the spindle 30 (FIG. 3) with the panels 12 extending between the support edges 32 parallel to each other and their interconnecting lengths of flexible material 24 providing small separations and hinges around the support edges 32 between their adjacent panel edges 14 so that (1) the panels 12 are supported over their full width on the spindle 30, (2) the panels 12 already wrapped around the spindle 30 will interlock with the next panel 12 being wrapped on in the manner of a tooth with a sprocket wheel to help lift them and so that the panels 12 will descend smoothly along the path when they are unwound, and (3) the panels 12 will form a reasonably compact wrap around the spindle 30.

The frame 16 includes the horizontal top portion 19 which with the sill 22 and two side portions 46 define the central through opening 18. The top portion 19 supports a flap 47 of stiff resiliently flexible polymeric material adajcent the path that will press against and make weather restricting sealing engagement with one of the panels 12 or lengths of flexible material 24 along an adjacent portion of the path which is defined by arcuate spaced strips 48 directed toward the spindle 30. The frame 16 may be of conventional wooden construction ad is adapted to be mounted in an opening through a wall in a conventional manner, such as by nailing or adhesives.

Figure 4:
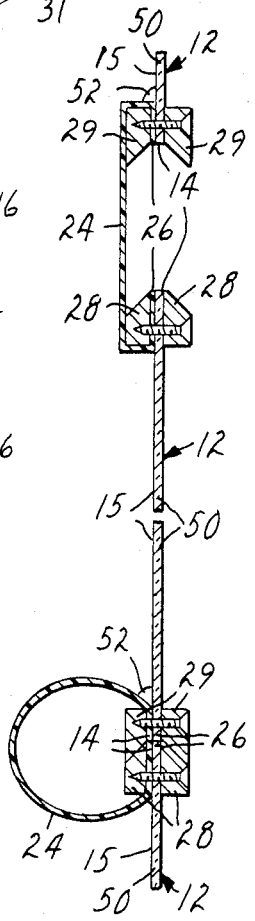
FIG. 4 is an enlarged fragmentary sectional view of the enclosure assembly of FIG. 1 showing two lower adjacent panels in a closed position and two upper adjacent panels in a position they assume when the uppermost panel is lifted.

As is best seen in FIG. 4, the panels 12 each comprise the elongate, generally rectangular slat 50 which may be of a transparent or translucent stiff, strong polymeric material such as a polymethyl methacrylate, a polystyrene, or a polyformaldehyde, and two pairs of strips 28 and 29 which are preferably of wood, each pair of strips 28 or 29 being on opposite sides and defining a different longitudinal panel edge 14.

The longitudinal panel edges 14 defined by the strips 28 are generally V shaped in cross section. The longitudinal panel edges 14 defined by the strips 29 project outwardly and are adapted to fit into the V-shaped longitudinal edges 14 of adjacent panels 12 defined by the strips 28 generally in the manner of a tongue and groove to provide a degree of weather tightness when pairs of adjacent panels 12 are in the closed position (see the bottom pair of adjacent panels 12 in FIG. 4).

Each of the lengths of flexible material 24 that are used to join the adjacent panels 12 has opposite edge portions each held between different ones of the adjacent strips 28 and 29 and the corresponding surfaces of the slats 50 included in the pair of adjacent panels 12 it interconnects with the edges 26 of the flexible material 24 generally aligned with and adjacent the panel edges 14 of the pair of adjacent panels 12. The length of flexible material 24 thus held along its opposite edge portions is sufficiently flexible that it will assume generally a cylindrical shape projecting from corresponding side surfaces 15 of the pair of adjacent panels 12 it interconnects when those panels 12 are in their closed position (see the strip of flexible material 24 connected between the bottom pair of panels 12 in FIG. 4); and will be tensioned around and between the strips 28 and 29 under which its edge portions are fastened when the uppermost panel 12 of the pair of adjacent panels 12 it interconnects is lifted (see the strip of flexible material 24 connected between the top two panels 12 in FIG. 4). The lengths of flexible material 24 can be fastened against the surfaces of the slats 50 facing indoors, but preferably are fastened against the surfaces of the slats 50 facing outside. The enclosure assembly 10 has a more pleasing appearance from the inside when the lengths of flexible material 24 are fastened on the outside surfaces of the slats 50, and the non porous lengths of flexible material 24 then help protect the strips 28 and 29 from the weather. Beads 52 of a conventional caulking material are applied along the uppermost joints between the lengths of flexible material 24 and the slats 50 to make those joints watertight.

The strips 28 and 29 are preferably fastened to the slats 50 in the manner described in my U.S. Pat. No. 4,524,814, incorporated herein by reference.

Figure 2:
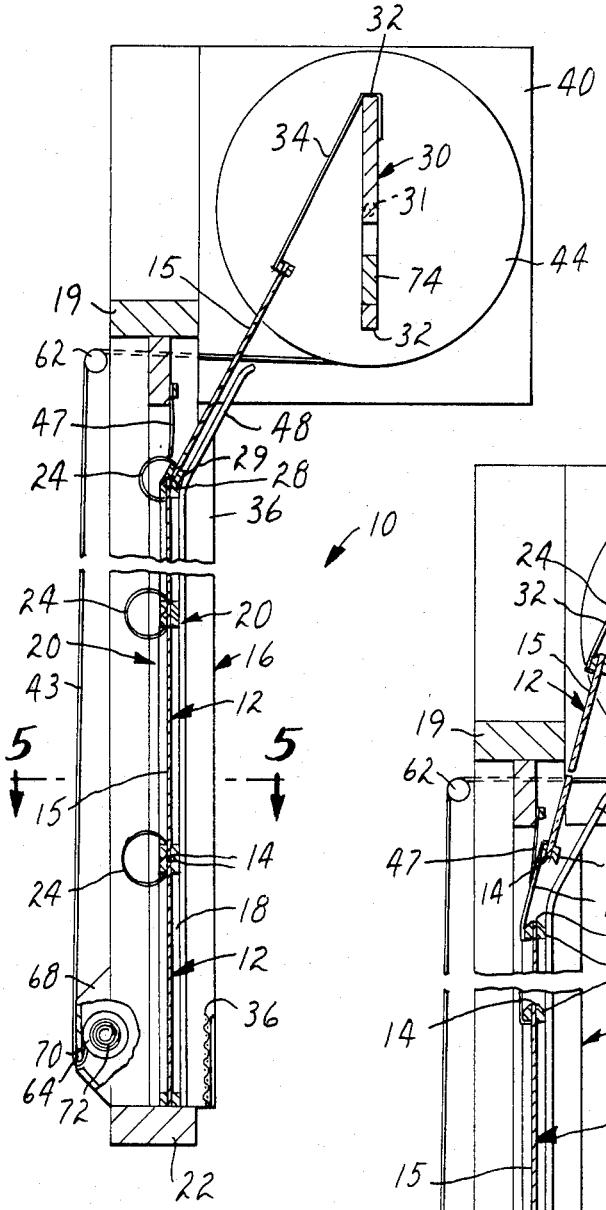
FIGS. 2 and 3 are sectional views taken approximately along line 2—2 of FIG. 1 and which respectively show panels of the enclosure assembly in different partially open positions.

The strap 43 by which the spindle 30 is rotated to wrap on the panels 12, or by which the spindle 30 is allowed to rotate because of the weight of the lowermost panels 12 so that the panels 12 unwrap from around the spindle 30, is guided along a path by means including the periphery of the disk 44, an opening 60 through one of the vertical side portions 46 of the frame 16 aligned with the periphery of the disk 44, a roller 62 rotatably mounted on the frame 16 around which the strap 43 changes direction about 90 degrees, and an edge 64 at an opening in the vertical side portion 46 leading to a take-up device 68 fixed to the frame 16 in which the distal end of the strap 43 is attached to and wound on a spool 70 (see FIG. 2) biased by a coil spring 72 to wind on the strap 43 and apply a tension to the strap 43. That tension presses the side of the strap 43 against the edge 64 so that that tension in the strap 43 in combination with friction between the strap 43 and the edge 64 ensures that the panels 12 will not unwind from the spindle 30. Weights 74 are also provided on one side of the spindle 30 positioned adjacent the rails 20 when the panels 12 are all wound on the spindle 30 so that when tension is manually released in the strap 43 leading to the disk 44, the spindle will rotate in a direction so that the normally lowermost panel moves into and down the rails 20.

Figure 5:
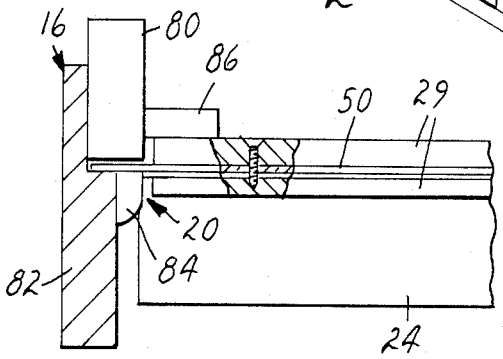
FIG. 5 is an enlarged sectional view taken approximately along line 5—5 of FIG. 2.

As is best seen in FIG. 5, which shows one pair of rails 20 (the other pair of rails 20 being a mirror image thereof), the two spaced opposed pairs of rails 20 included in the side portions 46 of the frame are formed by lapped boards 80 and 82 and an inside trim strip 84 which define a track for end portions of the slats 50 that extend a short distance beyond the ends of the strips 28 and 29, and an outside facing board 86 that projects from the board 62 a short distance along the strips 28 and 29 on the outer surfaces of the panels 12. The lengths 24 of flexible material are slightly longer that the strips 28 and 29 and end portions of the lengths 24 of flexible material projecting beyond the ends of the strips 28 and 29 resiliently press against the inner surfaces of the trim strips 84 to provide seals between the lengths 24 of flexible material and the frame 16.

OPERATION

To operate the enclosure assembly 10 (assuming it is initially closed) a person simply pulls on the portion of the strap 43 between the roller 62 and the take up device 68 to unwind the strap 43 from the periphery of the disk 44, causing the spindle 30 to rotate and wrap on the panels 12. As the panels 12 are wrapped around the spindle 30, they will be sequentially lifted out of the path across the opening 18 through the frame 16 starting from the top down, thereby causing slight sequential separation of the longitudinal panel edges 14 of pairs of adjacent panels 12 to tension the lengths of flexible material 24 connecting the panels 12 and lift the lower panel 12. The user can stop rotating the spindle 30 when he has moved the bottom panel 12 partially across the opening 18 to provide a desired amount of ventilation through the screen 36, or can continue to rotate the spindle 30 to lift the lowermost panel 12 completely (not shown) out of the opening 18. The strap 43 can then be allowed to wind up in the take up device 68 which will provide enough tension in the strap 43 to press the side of the strap 43 against the edge 64 so that friction thus caused and tension in the strap 43 will retain the panels 12 where desired. Subsequently the strap 43 can be pulled from the take up device 68 and allowed to be wound back on the disk 44 by the weight of the panels 12 so that panels 12 will be unwound from around the spindle 30, will move back along the rails 20 to their closed position with the lowermost panel 12 supported on the sill 22 and the other panels 12 supported above it.

The present invention has now been described with reference to one embodiment thereof. It will be apparent to those skilled in the art that many changes can be made in the embodiment described without departing from the scope of the present invention. For example the spindle 30 may be mounted inside a room or in the eaves outside of a room in the wall of which the enclosure assembly is mounted. The strap 43 and take up device 68 may be located inside or outside of the room with either location of the spindle 30. The lengths 24 of flexible material may be located inside or outside of the room. To minimize the widths of the lengths 24 of flexible material and thereby the diameter of the cylindrical projections they form (which is desirable) they should be on the same side of the wall as the spindle 30, however, they may also be on the opposite side as illustrated in the drawing. Also the screen 36 may be placed across the opening 18 on the inside or the outside of the frame 16. Thus the scope of the present invention should not be limited to the structures described in this application, but only by structures described by the language of the claims and the equivalents of those structures.

I claim:

1. An enclosure assembly comprising:

a plurality of stiff elongate generally rectangular panels having parallel longitudinal panel edges, and major side surfaces;

a frame defining a central through opening, having a top, guide means for positioning panels disposed across said opening one above another in edge-to edge relationship and for affording edgewise movement of said panels along said guide means through said top in a direction generally normal to said panel edges, and support means for supporting the lowermost panel of a stack of adjacent panels across said opening;

a plurality of elongate, generally rectangular lengths of non porous flexible material, each of said lengths of flexible material having opposite parallel longitudinal edges and edge portions adjacent said edges;

means along the adjacent edges of each pair of adjacent panels attaching the edge portions of a different one of said lengths of flexible material along corresponding side surfaces of said adjacent panels with the edges of the flexible material adjacent the edges of the adjacent panels to form the length of flexible material into a generally cylindrical projection from said corresponding side surfaces when the uppermost one of said adjacent panel edges is supported on the other, said lengths of flexible material being tensioned around and between said means for attaching along the panel edges of said adjacent panels and having widths that cause little relative movement of said panels away from each other when said uppermost panel is lifted in said guide means; and means for affording movement of said panels relative to said frame from a closed position with said panels covering said opening and supported one above the other on said support means, and an open position with all of said panels lifted above said opening.

2. An enclosure assembly according to claim 1 wherein each of said panels comprises a generally rectangular slat of stiff transparent polymeric material, said means attaching the edge portions of said lengths of flexible material to said adjacent panels comprises strips of wood on the side of said edge portions opposite said slats, and said lengths of flexible material are transparent polymeric material.

3. An enclosure assembly according to claim 1 wherein all of said panels have widths in the range of about ten to fourteen inches.

4. An enclosure assembly according to claim 1 wherein all of said lengths of non porous flexible material have widths in the range of about two to five inches.

5. An enclosure assembly according to claim 1 wherein said panels comprise thermal insulating material.

6. An enclosure assembly according to claim 1 wherein the adjacent edges of said panels are shaped to make tongue and groove-like engagement with each other.

7. An enclosure according to claim 1 wherein said means for affording movement of said panels from said closed to said open positions comprises a spindle mounted adjacent the top of said frame for rotation about a generally horizontal axis, said spindle having only two opposite axially extending support edges each about equally spaced from opposite sides of the axis, means for attaching the uppermost edge of the uppermost of said panels to said spindle, and manually actuatable means for rotating said spindle to wrap said panels and lengths of flexible material around said support edges, said means for attaching, the widths of the panels, and the widths of the lengths of flexible material being adapted to position said lengths of flexible material around said support edges and said panels between said support edges generally parallel to each other as said panels and lengths of flexible material are wound around said spindle.

8. An enclosure assembly according to claim 1 further including a piece of screen attached to said frame entirely across said through opening at a position spaced from and generally parallel to said guide means.

9. An enclosure assembly comprising:

a plurality of stiff elongate generally rectangular panels having parallel longitudinal panel edges, generally uniform widths between said panel edges, and major side surfaces;

a frame defining a central through opening, having a top, guide means for positioning panels disposed across said opening one above another in edge-to edge relationship and for affording edgewise movement of said panels along said guide means through said top in a direction generally normal to said panel edges, and support means for supporting the lowermost panel of a stack of adjacent panels across said opening;

a plurality of elongate, generally rectangular lengths of flexible non porous material having generally uniform widths, each of said lengths of flexible material having opposite parallel longitudinal edges and edge portions adjacent said edges;

means along the adjacent edges of each pair of adjacent panels attaching the edge portions of a different one of said lengths of flexible material along corresponding side surfaces of said adjacent panels with the edges of the flexible material adjacent the edges of the adjacent panels to form the length of flexible material into a generally cylindrical projection from said corresponding side surfaces when the uppermost one of said adjacent panel edges is supported on the other, said lengths of flexible material being tensioned around and between said means for attaching along the panel edges of said adjacent panels and having widths that cause little relative movement of said panels away from each other when said uppermost panel is lifted in said guide means; and means for affording movement of said panels relative to said frame from a closed position with said panels covering said opening and supported one above the other on said support means, and an open position with all of said panels lifted above said opening comprising a spindle mounted adjacent the top of said frame for rotation about a generally horizontal axis, said spindle having only two opposite axially extending support edges each about equally spaced from opposite sides of the axis, means for attaching the uppermost edge of the uppermost of said panels to said spindle, and manually activatable means for rotating said spindle to wrap said panels and lengths of flexible material around said support edges, said means for attaching, the widths of the panels, and the widths of the strips of flexible material being adapted to position said lengths of flexible material around said support edges and said panels between said support edges generally parallel to each other as said panels and lengths of flexible material are wound around said spindle.

10. An enclosure assembly according to claim 9 wherein each of said panels comprises a generally rectangular slat of stiff transparent polymeric material, said means attaching the edge portions of said lengths of flexible material to said adjacent panels comprises strips of wood on the side of said edge portions opposite said slats, and said lengths of flexible material are transparent polymeric material.

11. An enclosure assembly according to claim 9 wherein all of said panels have widths in the range of about ten to fourteen inches.

12. An enclosure assembly according to claim 9 wherein all of said lengths of non porous flexible material have widths in the range of about two to five inches.

13. An enclosure assembly according to claim 9 wherein said panels comprise thermal insulating material.

14. An enclosure assembly according to claim 9 wherein the adjacent edges of said panels are shaped to make tongue and groove-like engagement with each other.

15. An enclosure assembly according to claim 9 further including a piece of screen attached to said frame entirely across said through opening at a position spaced from and generally parallel to said guide means.

* * * * *